US007736215B2

(12) United States Patent
Sekiya et al.

(10) Patent No.: US 7,736,215 B2
(45) Date of Patent: Jun. 15, 2010

(54) POLISHING TOOL AND POLISHING METHOD AND APPARATUS USING SAME

(75) Inventors: Sinnosuke Sekiya, Tokyo (JP); Setsuo Yamamoto, Tokyo (JP); Yutaka Koma, Tokyo (JP); Masashi Aoki, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 11/987,382

(22) Filed: Nov. 29, 2007

(65) Prior Publication Data

US 2008/0085662 A1 Apr. 10, 2008

Related U.S. Application Data

(62) Division of application No. 10/100,901, filed on Mar. 20, 2002.

(30) Foreign Application Priority Data

| | | |
|---|---|---|
| Mar. 28, 2001 | (JP) | 2001-93397 |
| Mar. 28, 2001 | (JP) | 2001-93398 |
| Mar. 28, 2001 | (JP) | 2001-93399 |
| Oct. 9, 2001 | (JP) | 2001-311450 |

(51) Int. Cl.
*B24B 1/00* (2006.01)

(52) U.S. Cl. ..... 451/41; 451/59; 451/532; 451/537

(58) Field of Classification Search ..... 81/60–63, 81/177.4, 490, 177.85, 128, 129; 451/41, 451/59, 63, 285, 287, 490, 526, 532, 533, 451/537, 539, 530

See application file for complete search history.

(56) References Cited

U.S. PATENT DOCUMENTS

| | | | | |
|---|---|---|---|---|
| 5,369,916 | A | 12/1994 | Jefferies et al. | |
| 5,626,509 | A | 5/1997 | Hayashi | |
| 5,962,120 | A | 10/1999 | Keipert | |
| 6,069,080 | A * | 5/2000 | James et al. | 438/691 |
| 6,126,532 | A | 10/2000 | Sevilla et al. | |
| 6,165,056 | A | 12/2000 | Hayashi et al. | |
| 6,328,634 | B1 | 12/2001 | Shen et al. | |
| 6,431,964 | B1 | 8/2002 | Ishikawa et al. | |
| 7,182,673 | B2 * | 2/2007 | Hardikar et al. | 451/41 |
| 7,189,155 | B2 * | 3/2007 | Hoshino et al. | 451/527 |
| 2003/0211816 | A1 * | 11/2003 | Liu et al. | 451/56 |

FOREIGN PATENT DOCUMENTS

| | | |
|---|---|---|
| EP | 1 108 500 | 6/2001 |
| EP | 0 842 738 | 10/2001 |
| JP | 56-56382 | 5/1981 |
| JP | 3-190675 | 8/1991 |
| JP | 9-193008 | 7/1997 |
| JP | 11-156711 | 6/1999 |
| JP | 11-198007 | 7/1999 |

(Continued)

OTHER PUBLICATIONS

Austrian Patent Office Search Report via IPOS (Singapore).
Austrian Patent Office Written Opinion via IPOS (Singapore).

*Primary Examiner*—Eileen P. Morgan
(74) *Attorney, Agent, or Firm*—Smith, Gambrell & Russell, LLP

(57) ABSTRACT

A polishing tool comprising a support member, and polishing means fixed to the support member. The polishing means is composed of felt having a density of 0.20 g/cm$^3$ or more and a hardness of 30 or more, and abrasive grains dispersed in the felt. A polishing method and apparatus involving pressing the polishing means against a surface of a workpiece to be polished, while rotating the workpiece and also rotating the polishing tool.

17 Claims, 8 Drawing Sheets

FOREIGN PATENT DOCUMENTS

| | | |
|---|---|---|
| JP | 2000-254857 | 9/2000 |
| JP | 2000-301459 | 10/2000 |
| JP | 2000-343440 | 12/2000 |
| WO | 00/12262 | 3/2000 |

* cited by examiner

POLISHING TOOL AND POLISHING METHOD AND APPARATUS USING SAME

CROSS REFERENCE TO RELATED APPLICATION

This application is a division of Ser. No. 10/100,901, filed Mar. 20, 2002 and which is being incorporated in its entirety herein by reference.

FIELD OF THE INVENTION

This invention relates to a polishing tool, especially a polishing tool suitable for polishing a back side of a semiconductor wafer having processing distortion, and a polishing method and apparatus using such a polishing tool.

DESCRIPTION OF THE PRIOR ART

In a process for manufacturing semiconductor chips, many rectangular areas are demarcated by streets arranged in a lattice pattern on a face side of a semiconductor wafer, and semiconductor circuits are disposed in the respective rectangular areas. The semiconductor wafer is divided along the streets to convert the rectangular areas into semiconductor chips. To make the semiconductor chips compact and lightweight, it is often desired to grind a back side of the semiconductor wafer before separation of the rectangular areas into individual chips, thereby decreasing the thickness of the semiconductor wafer. Grinding of the back side of the semiconductor wafer is usually performed by pressing grinding means against the back side of the semiconductor wafer while rotating the grinding means at a high speed, the grinding means being formed by bonding diamond abrasive grains with a suitable bonding agent such as a resin bonding agent. When the back side of the semiconductor wafer is ground by such a grinding method, so-called processing distortion is generated in the back side of the semiconductor wafer, thereby decreasing transverse rupture strength considerably. To eliminate processing distortion generated in the back side of the semiconductor wafer and thus avoid a decrease in transverse rupture strength, it has been proposed to polish the ground back side of the semiconductor wafer with the use of free abrasive grains, or to chemically etch the ground back side of the semiconductor wafer with the use of an etching solution containing nitric acid and hydrofluoric acid. Further, Japanese Unexamined Patent Publication No. 2000-343440 discloses the polishing of a back side of a semiconductor wafer with the use of polishing means constituted by dispersing abrasive grains in a suitable cloth.

Polishing using free abrasive grains, however, involves the problems that the supply, recovery, etc. of the free abrasive grains require tiresome procedure, leading to a low efficiency, and that the free abrasive grains used in large amounts have to be disposed of as industrial wastes. Chemical etching using an etching solution also poses the problem that the etching solution used in a large amount has to be disposed of as industrial waste. Polishing by polishing means constituted by dispersing abrasive grains in cloth, by contrast, does not form a large amount of a substance to be disposed of as industrial waste. However, this type of polishing has not been successful in achieving a polishing efficiency and a polishing quality which are sufficiently satisfactory.

SUMMARY OF THE INVENTION

An object of the present invention is to provide a new and improved polishing tool which polishes a back side of a semiconductor wafer with a high polishing efficiency and a high polishing quality, without forming a large amount of a substance to be disposed of as industrial waste, thereby being capable of eliminating processing distortion existent in the back side of the semiconductor wafer.

A further object of the present invention is to provide a novel and improved polishing method and apparatus which use the above-mentioned polishing tool.

An additional object of the present invention is to provide a new and improved grinding/polishing method and a new and improved grinding/polishing machine which grind a back side of a semiconductor wafer and then polish the back side of the semiconductor wafer with a high polishing efficiency and a high polishing quality, thereby being capable of eliminating processing distortion generated owing to the grinding.

The inventors of the present invention conducted in-depth studies, and have found that the above objects can be attained by a polishing tool equipped with polishing means formed by dispersing abrasive grains in felt having a density of 0.20 g/cm$^3$ or more and a hardness of 30 or more.

According to an aspect of the present invention, there is provided, as the polishing tool attaining the above object, a polishing tool comprising a support member and polishing means fixed to the support member, the polishing means being composed of felt having a density of 0.20 g/cm$^3$ or more and a hardness of 30 or more, and abrasive grains dispersed in the felt.

Preferably, the density of the felt is 0.40 g/cm$^3$ or more, and the hardness of the felt is 50 or more. The polishing means preferably contains 0.05 to 1.00 g/cm$^3$, especially 0.20 to 0.70 g/cm$^3$, of the abrasive grains. The polishing surface of the polishing means can include both of a course surface and a wale surface of the felt. The abrasive grains preferably have particle diameters of 0.01 to 100 μm. The abrasive grains may be those including one or more of silica, alumina, forsterite, steatite, mullite, cubic boron nitride, diamond, silicon nitride, silicon carbide, boron carbide, barium carbonate, calcium carbonate, iron oxide, magnesium oxide, zirconium oxide, cerium oxide, chromium oxide, tin oxide, and titanium oxide. The support member preferably has a circular support surface, and the polishing means preferably is in the form of a disc bonded to the circular support surface.

According to another aspect of the present invention, there is provided, as the polishing method which attains the further object, a polishing method comprising rotating a workpiece and also rotating polishing means, and pressing the polishing means against a surface of the workpiece to be polished, and wherein the polishing means is constructed by dispersing abrasive grains in felt having a density of 0.20 g/cm$^3$ or more and a hardness of 30 or more.

In a preferred embodiment, the workpiece is a semiconductor wafer, and the surface to be polished is a ground back side. The workpiece and the polishing means are preferably rotated in opposite directions. The rotational speed of the workpiece is preferably 5 to 200 rpm, especially 10 to 30 rpm, while the rotational speed of the polishing means is preferably 2,000 to 20,000 rpm, especially 5,000 to 8,000 rpm. The polishing means is preferably pressed against the workpiece at a pressing force of 100 to 300 g/cm$^2$, especially 180 to 220 g/cm$^2$. In a preferred embodiment, the workpiece is a nearly disc-shaped semiconductor wafer, the polishing means is disc-shaped, the outer diameter of the semiconductor wafer and the outer diameter of the polishing means are nearly the same, and the central axis of the semiconductor wafer and the central axis of the polishing means are positioned so as to be displaced from each other by a third to a half of the radius of the semiconductor wafer. The polishing means preferably is moved back and forth relative to the workpiece in a direction perpendicular to the rotation axis of the polishing means and perpendicular to a direction of displacement of the central axis of the semiconductor wafer and the central axis of the polishing means. The polishing means is preferably moved back and forth at such a speed as to be reciprocated once in 30 to 60 seconds at an amplitude equal to or somewhat larger than the diameter of the semiconductor wafer.

According to still another aspect of the present invention, there is provided, as the grinding/polishing method which attains the additional object, a grinding/polishing method comprising a grinding step of grinding a back side of a semiconductor wafer with a grinding member; and a polishing step, after the grinding step, of rotating the semiconductor wafer and also rotating polishing means, and pressing the polishing means against the back side of the semiconductor wafer, the polishing means being constructed by dispersing abrasive grains in felt.

Preferably, a cleaning step of jetting a cleaning liquid at the back side of the semiconductor wafer is included after the grinding step and before the polishing step, and a drying step of jetting air at the back side of the semiconductor wafer is included after the cleaning step and before the polishing step.

According to a further aspect of the present invention, there is provided, as the polishing apparatus which attains the further object, a polishing apparatus comprising chuck means rotatably mounted for holding a workpiece, and a polishing tool mounted rotatably, and wherein the polishing tool includes polishing means constructed by dispersing abrasive grains in felt having a density of 0.20 g/cm$^3$ or more and a hardness of 30 or more, and the chuck means is rotated and the polishing tool is also rotated, and the polishing means of the polishing tool is pressed against the workpiece held by the chuck means, whereby the workpiece is polished.

In a preferred embodiment, a semiconductor wafer, as the workpiece, is held on the chuck means, and the polishing means polishes a ground back side of the semiconductor wafer. The chuck means and the polishing means are preferably rotated in opposite directions. The rotational speed of the chuck means is preferably 5 to 200 rpm, especially 10 to 30 rpm, while the rotational speed of the polishing tool is preferably 2,000 to 20,000 rpm, especially 5,000 to 8,000 rpm. The polishing means is preferably pressed against the workpiece at a pressing force of 100 to 300 g/cm$^2$, especially 180 to 220 g/cm$^2$. In a preferred embodiment, the workpiece is a nearly disc-shaped semiconductor wafer, the polishing means is disc-shaped, the outer diameter of the semiconductor wafer and the outer diameter of the polishing means are nearly the same, and the central axis of the semiconductor wafer and the central axis of the polishing means are positioned so as to be displaced from each other by a third to a half of the radius of the semiconductor wafer. The polishing tool preferably is moved back and forth relative to the chuck means in a direction perpendicular to the rotation axis of the polishing tool and perpendicular to a direction of displacement of the central axis of the semiconductor wafer and the central axis of the polishing means. The polishing means is preferably moved back and forth at such a speed as to be reciprocated once in 30 to 60 seconds at an amplitude equal to or somewhat larger than the diameter of the semiconductor wafer.

According to a still further aspect of the present invention, there is provided, as the grinding/polishing machine which attains the additional object, a grinding/polishing machine for grinding a back side of a semiconductor wafer and then polishing the back side of the semiconductor wafer, comprising:

a turntable rotated intermittently;

at least one chuck means rotatably mounted on the turntable;

at least one grinding device; and a polishing apparatus, and wherein:

the semiconductor wafer to be ground and polished is held on the chuck means, with the back side of the semiconductor wafer being exposed;

the turntable is intermittently rotated, whereby the chuck means is located sequentially in at least one grinding zone and at least one polishing zone;

the grinding device includes a grinding tool, and the grinding tool is caused to act on the back side of the semiconductor wafer held by the chuck means located in the grinding zone to grind the back side of the semiconductor wafer; and the polishing apparatus includes a polishing tool mounted rotatably, the polishing tool has polishing means constructed by dispersing abrasive grains in felt, the chuck means located in the polishing zone is rotated and the polishing tool is also rotated, and the polishing means is pressed against the back side of the semiconductor wafer held by the chuck means, whereby the back side of the semiconductor wafer is polished.

Preferably, the grinding/polishing machine is further equipped with cleaning means for jetting a cleaning liquid at the back side of the semiconductor wafer held by the chuck means located in the polishing zone, and drying means for jetting air at the back side of the semiconductor wafer held by the chuck means located in the polishing zone.

Upon further in-depth studies, the present inventors constructed polishing means in a polishing tool from a massive body formed from at least two types of fibers selected from natural fibers, including various animal hairs, and synthetic fibers, and abrasive grains dispersed in such a massive body. The inventors have found that compared with a polishing tool having polishing means constructed from a massive body, like felt, composed of fibers of a single type, and abrasive grains dispersed in such a massive body, the above polishing tool achieves heat release from the polishing means and/or workpiece even more effectively, and improves the quality and efficiency of polishing, although the reasons for these advantages are not entirely clear.

According to an additional aspect of the present invention, there is provided, as the polishing tool which attains the aforementioned object, a polishing tool comprising a support member and polishing means fixed to the support member, and wherein the polishing means is composed of a massive body formed from at least two types of fibers selected from natural fibers, including various animal hairs, and synthetic fibers, and abrasive grains dispersed in the massive body.

The term "natural fibers" used herein refers to animal-based natural fibers including not only wool and goat hair, but also pig hair, horse hair, cattle hair, dog hair, cat hair, raccoon dog hair, and fox hair, vegetable fibers such as cotton and hemp, and mineral fibers such as asbestos. The term "massive body" used herein refers to an object, such as felt or a fiber bundle, which is formed by compressing fibers into a mass form.

In a preferred embodiment, the massive body is composed of a first felt formed from first fibers, and a second felt formed from second fibers. The first fibers may be wool or goat hair, while the second fibers may be goat hair or wool. Preferably, the massive body is constructed by forming a plurality of voids in the first felt, and fitting the second felt into each of the plurality of voids. In a polishing surface of the polishing means, it is preferred that the second felts are arranged dispersedly in the first felt. In another preferred embodiment, the massive body is composed of felt formed from first fibers, and a fiber bundle formed from second fibers. The first fibers may be wool or goat hair, while the second fibers may be animal hair other than wool and goat hair. Preferably, the massive body is constructed by forming a plurality of voids in the felt, and fitting the fiber bundle into each of the plurality of voids. In a polishing surface of the polishing means, it is preferred that the fiber bundles are arranged dispersedly in the felt. In still another preferred embodiment, the massive body is composed of the felt formed by mixing at least two types of fibers. The massive body can be constructed from felt formed by mixing wool and goat hair. In any of the embodiments, the massive body preferably has a density of 0.20 g/cm$^3$ or more, especially 0.40 g/cm$^3$ or more, and a hardness of 30 or more, especially 50 or more.

DETAILED DESCRIPTION OF THE PREFERRED EMBODIMENTS

Embodiments of the present invention will be described in further detail by reference to the accompanying drawings.

Figure 1:
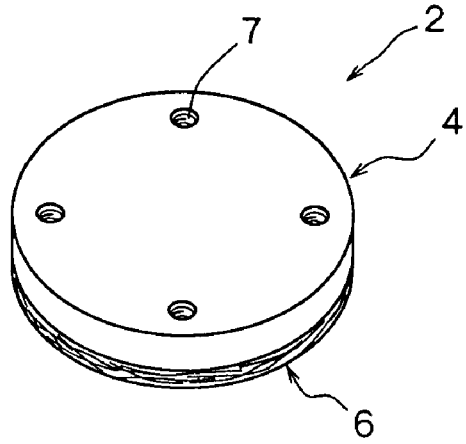
FIG. 1 is a perspective view showing a preferred embodiment of a polishing tool constructed in accordance with the present invention.
Figure 2:
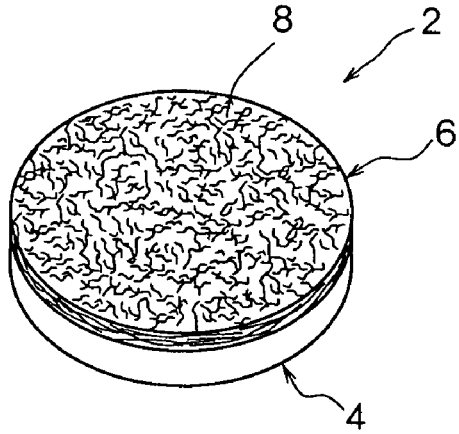
FIG. 2 is a perspective view showing the polishing tool of FIG. 1 in an inverted state.

FIGS. 1 and 2 show a preferred embodiment of a polishing tool constructed in accordance with the present invention. The illustrated polishing tool, shown entirely by a numeral 2, is composed of a support member 4 and polishing means 6. The support member 4 is advantageously formed from a suitable metal such as aluminum, is disc-shaped, and has a flat circular support surface, namely, a lower surface. As shown in FIG. 1, a plurality of (four in the drawings) tapped blind holes 7, extending downward from an upper surface of the support member 4, are formed at circumferentially spaced locations in the support member 4. The polishing means 6 is also disc-shaped, and the outer diameter of the support member 4 and the outer diameter of the polishing means 6 are substantially the same. The polishing means 6 is bonded to the lower surface of the support member 4 (i.e., its flat circular support surface) by a suitable adhesive such as an epoxy resin adhesive.

It is important for the polishing means 6 to be composed of felt and many abrasive grains dispersed in the felt. Importantly, the felt has a density of 0.20 g/cm$^3$ or more, especially 0.40 g/cm$^3$ or more, and a hardness of 30 or more, especially 50 or more. The term "hardness", as used herein, refers to hardness measured according to the standards JIS K6253-5 (durometer hardness test). If the density and hardness are excessively low, the desired polishing efficiency and polishing quality cannot be achieved. The felt is not limited to one composed of wool, but may be felt composed of suitable synthetic fibers such as polyester, polypropylene, heat resistant nylon, polyester, acrylic, rayon, and Kevlar, flame resistant fibers such as silica and glass, and natural fibers such as cotton and hemp. In terms of polishing efficiency and polishing quality, felt containing 90% or more of wool, especially felt formed of 100% wool, is preferred. The amount of the abrasive grains dispersed in the felt is preferably 0.05 to 1.00 g/cm$^3$, particularly 0.20 to 0.70 g/cm$^3$.

The abrasive grains dispersed in the felt preferably have a particle size of 0.01 to 100 μm. The abrasive grains may be formed from any of silica, alumina, forsterite, steatite, mullite, cubic boron nitride, diamond, silicon nitride, silicon carbide, boron carbide, barium carbonate, calcium carbonate, iron oxide, magnesium oxide, zirconium oxide, cerium oxide, chromium oxide, tin oxide, and titanium oxide. If desired, two or more types of abrasive grains may be dispersed in the felt. To disperse the abrasive grains appropriately in the felt, it is permissible to incorporate the abrasive grains into a suitable liquid, and then impregnate the felt with the liquid, or to incorporate the abrasive grains, as desired, into the fibers as a material for the felt during the manufacturing process of the felt. After the abrasive grains are appropriately dispersed in the felt, the felt is impregnated with a suitable liquid adhesive, for example, a phenolic resin adhesive or an epoxy resin adhesive, so that the abrasive grains can be bound to the interior of the felt by such an adhesive.

Figure 3:
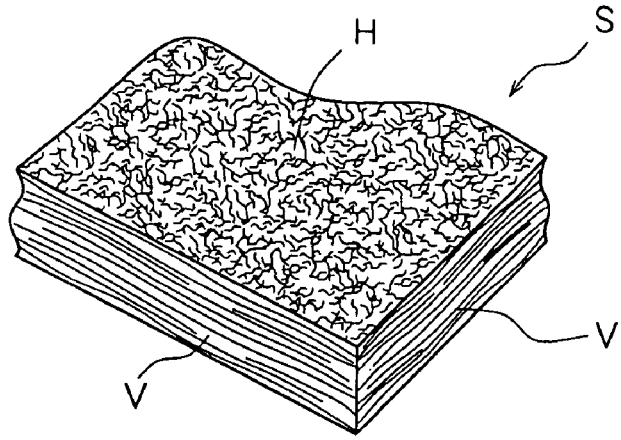
FIG. 3 is a perspective view showing a part of felt.
Figure 4:
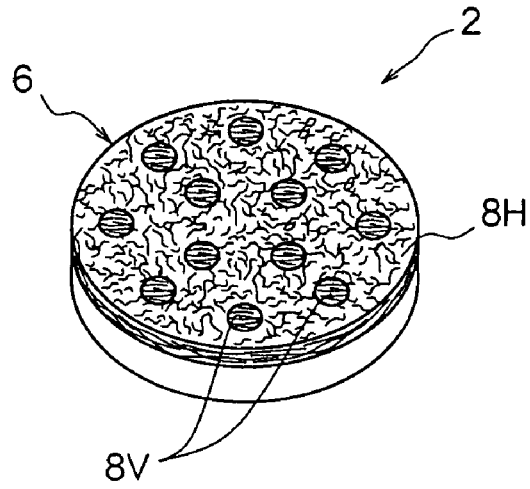
FIG. 4 is a perspective view showing another embodiment, in an inverted state, of the polishing tool constructed in accordance with the present invention.
Figure 5:
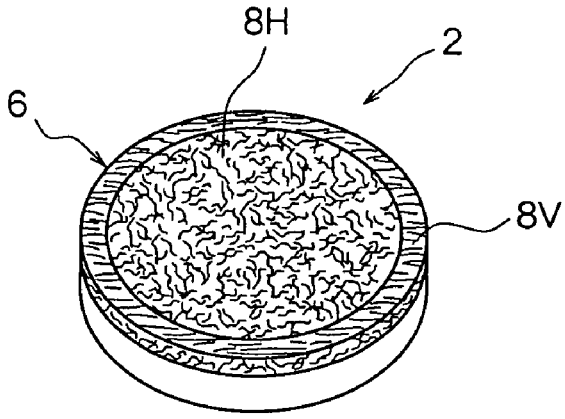
FIG. 5 is a perspective view showing still another embodiment, in an inverted state, of the polishing tool constructed in accordance with the present invention.
Figure 6:
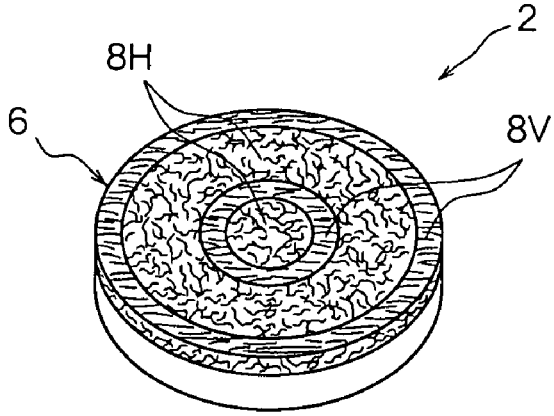
FIG. 6 is a perspective view showing a further embodiment, in an inverted state, of the polishing tool constructed in accordance with the present invention.
Figure 7:
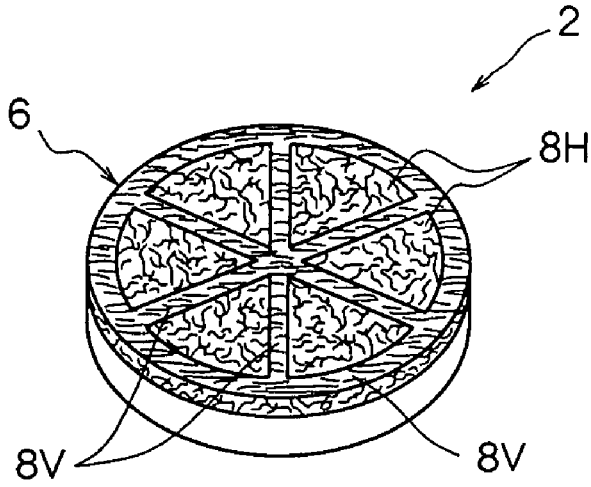
FIG. 7 is a perspective view showing a still further embodiment, in an inverted state, of the polishing tool constructed in accordance with the present invention.
Figure 8:
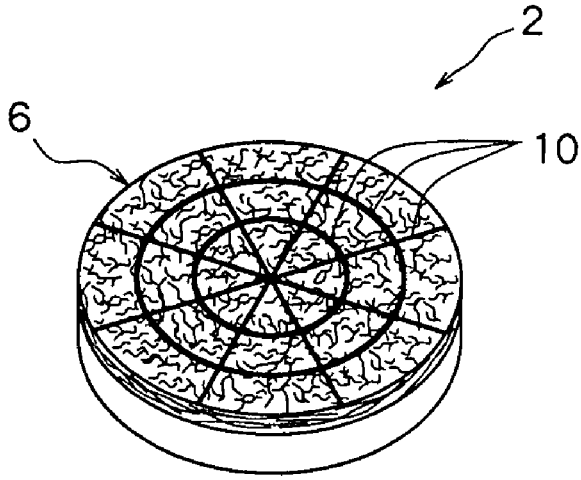
FIG. 8 is a perspective view showing an additional embodiment, in an inverted state, of the polishing tool constructed in accordance with the present invention.

As schematically shown in FIG. 3, the felt is produced as a sheet S, and its surfaces in its direction of extension, namely, its face side and back side, are called course surfaces H, while its surfaces in its thickness direction are called wale surfaces V. In the polishing tool 2 shown in FIGS. 1 and 2, the felt constituting the polishing means 6 is formed by cutting the sheet into a disc form. Thus, the polishing surface of the polishing means 6, i.e., a lower surface 8, is formed of the course surface H of the felt. If desired, the wale surface V of the felt can be used as the polishing surface. According to the inventors' experience, compared with the use of the course surface H of the felt as the polishing surface, the use of the wale surface V of the felt as the polishing surface has been found to increase the amount of polishing by 20 to 30%. To increase the polishing efficiency, without lowering the polishing quality, it is acceptable to form the polishing surface of the polishing means 6, i.e., its lower surface, as a mixture of the course surface H and the wale surface V of the felt, as illustrated in FIGS. 4 to 7. In the polishing tool 2 shown in FIG. 4, the lower surface of the polishing means 6 includes a course surface area 8H formed from the course surface H of the felt, and a plurality of wale surface areas 8V formed from the wale surface V of the felt. The wale surface areas 8V are shaped like small circles, and arranged dispersedly in the course surface area 8H. In the polishing tool 2 shown in FIG. 5, the lower surface of the polishing means 6 is composed of a central circular course surface area 8H and an outer annular wale surface area 8V surrounding the course surface area 8H. In the polishing tool 2 shown in FIG. 6, the lower surface of the polishing means 6 is constructed by arranging course surface areas 8H and wale surface areas 8V alternately concentrically. In the polishing tool 2 shown in FIG. 7, the lower surface of the polishing means 6 includes a plurality of segment-shaped course surface areas 8H, a plurality of wale surface areas 8V extending radially among the course surface areas 8H, and an outer annular wale surface area 8V surrounding the course surface areas 8H and the wale surface areas 8V. As shown in FIG. 8, moreover, a plurality of slits 10 can be cut in the polishing means 6. The slits 10 may be shaped like a plurality of circles arranged concentrically and/or may be in the form of radial lines arranged at equiangular distances.

Figure 9:
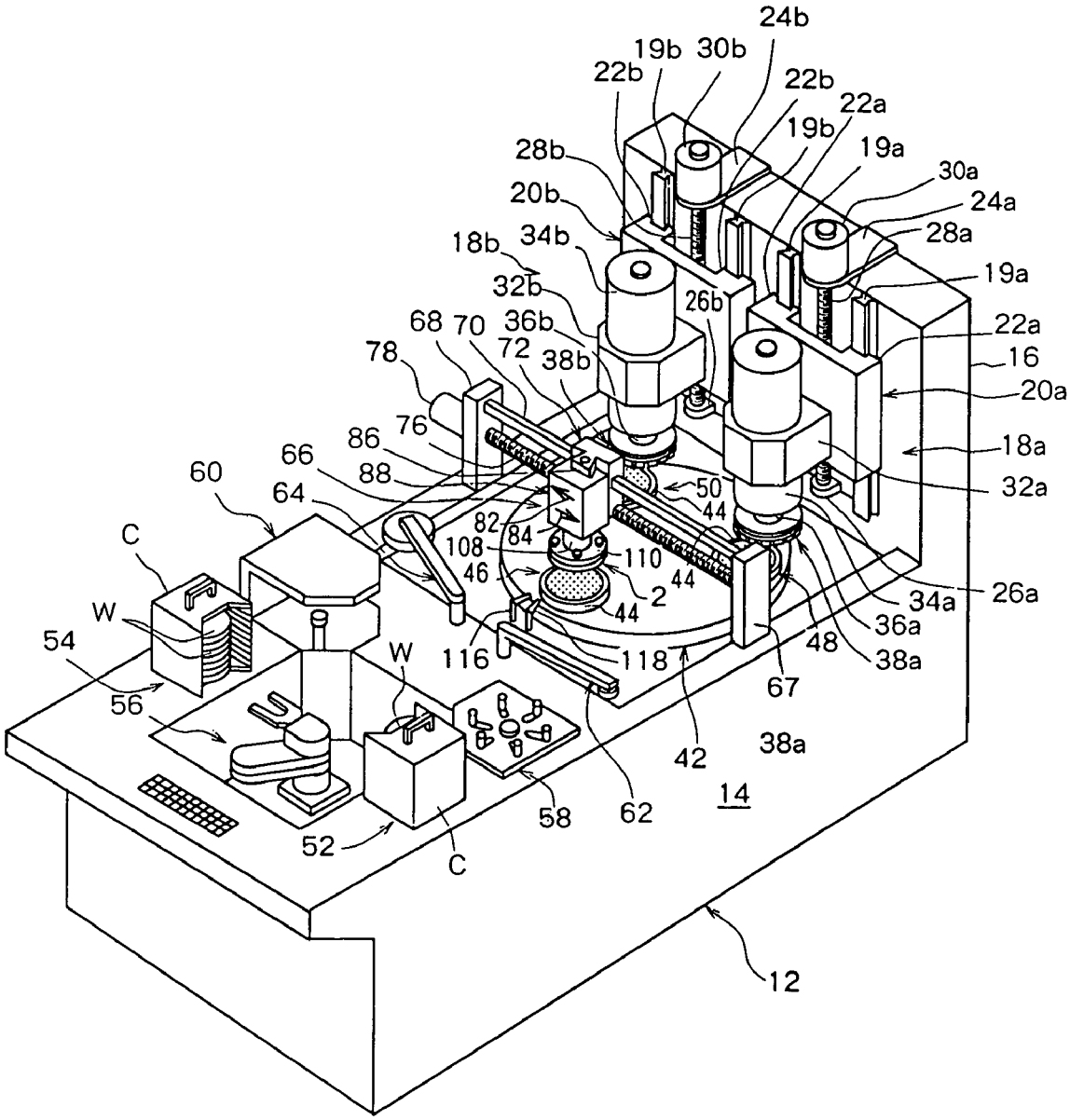
FIG. 9 is a perspective view showing a preferred embodiment of a grinding/polishing machine constructed in accordance with the present invention.

FIG. 9 shows a grinding/polishing machine for performing a grinding step for grinding the back side of a semiconductor wafer, and performing a subsequent polishing step in which the above-described polishing tool 2 is applied. The illustrated grinding/polishing machine has a housing entirely indicated by a numeral 12. The housing 12 has a main portion 14 in the form of a rectangular parallelepiped extending slenderly. An upright wall 16 extending substantially vertically upward is disposed in a rear end portion of the main portion 14. Two grinding devices, i.e., a rough grinding device 18*a* and a precision grinding device 18*b*, are disposed on the upright wall 16. In more detail, two pairs of guide rails 19*a* and 19*b* are fixed to the front surface of the upright wall 16. The respective guide rails of the guide rail pairs 19*a* and 19*b* extend substantially vertically. Slide blocks 20*a* and 20*b* are mounted on the guide rail pairs 19*a* and 19*b* so as to be vertically slidable. Each of the slide blocks 20*a* and 20*b* has two legs 22*a* and two legs 22*b*. Each of the legs 22*a* and 22*b* is slidably engaged with each of the rails of the guide rail pairs 19*a* and 19*b*. Threaded shafts 28*a* and 28*b*, which extend substantially vertically, are rotatably mounted on the front surface of the upright wall 16 by support members 24*a* and 24*b* and support members 26*a* and 26*b*. Electric motors 30*a* and 30*b*, which may be pulse motors, are also mounted on the support members 24*a* and 24*b*. Output shafts of the motors 30*a* and 30*b* are connected to the threaded shafts 28*a* and 28*b*. Connecting portions (not shown) protruding rearward are formed in the slide blocks 20*a* and 20*b*. Tapped through-holes extending vertically are formed in the connecting portions, and the threaded shafts 28*a* and 28*b* are screwed into these tapped holes. Thus, when the motors 30*a* and 30*b* are rotated in the normal direction, the slide blocks 20*a* and 20*b* are lowered, and when the motors 30*a* and 30*b* are rotated in the reverse direction, the slide blocks 20*a* and 20*b* are raised. Support portions 32*a* and 32*b* protruding forward are formed on the slide blocks 20*a* and 20*b*, and cases 34*a* and 34*b* are fixed to the support portions 32*a* and 32*b*. Rotating shafts 36*a* and 36*b* extending substantially vertically are rotatably mounted in the cases 34*a* and 34*b*. Electric motors (not shown) are disposed in the cases 34*a* and 34*b*, and output shafts of these motors are connected to the rotating shafts 34*a* and 34*b*. Disc-shaped mounting members 36*a* and 36*b* are fixed to the lower ends of the rotating shafts 34*a* and 34*b*, and grinding tools 38*a* and 38*b* are mounted on the mounting members 36*a* and 36*b*. A plurality of arc-shaped grinding members are disposed on each of the lower surfaces of the grinding tools 38*a* and 38*b*. Advantageously, the grinding member has been formed by binding diamond grains with the use of a suitable binder such as a resin bonding agent. When the motors disposed in the cases 34*a* and 34*b* are energized, the grinding tools 38*a* and 38*b* are rotated at a high speed.

With reference to FIG. 9, a turntable 42 is disposed on a latter-half upper surface of the main portion 14 of the housing 12. The turntable 42 is mounted so as to be rotatable about a central axis extending substantially vertically. A suitable electric motor (not shown) is driving connected to the turntable 42, and as will be mentioned later, the turntable 42 is intermittently rotated 120 degrees at a time. Three chuck means 44 are disposed at equiangular distances in the circumferential direction on the turntable 42. The illustrated chuck means 44 are each composed of a porous disc mounted so as to be rotatable about a central axis extending substantially vertically. A suitable electric motor (not shown) is driving connected to each of the chuck means 44, and the chuck means 44 are rotated at a rotational speed which may be 5 to 100 rpm. A vacuum source (not shown) is in selective communication with the chuck means 44, and as will be mentioned later, a semiconductor wafer placed on the chuck means 44 is vacuum attracted to the chuck means 44. By intermittently rotating the turntable 42 through 120 degrees at a time, each of the chuck means 44 is sequentially located in a carry-in/carry-out zone 46, a rough grinding zone 48, and a precision grinding zone 50. As will be clearly understood from an explanation offered later, the carry-in/carry-out zone 46 also functions as a polishing zone.

A cassette carry-in zone 52, a cassette carry-out zone 54, a transport mechanism 56, semiconductor wafer accepting means 58, and cleaning means 60 are disposed in a first-half upper surface of the main portion 14 of the housing 12. Transport mechanisms 62 and 64 are disposed on an intermediate upper surface of the main portion 14 of the housing 12. A cassette C accommodating a plurality of semiconductor wafers W having a back side to be ground and polished is placed in the cassette carry-in zone 52. A cassette C for accommodating a semiconductor wafer W whose back side has been ground and polished is placed in the cassette carry-out zone 54. The transport mechanism 56 carries one semiconductor wafer W, at a time, out of the cassette C placed in the cassette carry-in zone 52, turns the semiconductor wafer W upside down, and places it on the semiconductor wafer accepting means 58. The transport mechanism 62 carries the semiconductor wafer W, which has been placed on the semiconductor wafer accepting means 58 with its back side facing upward, onto the chuck means 44 located in the carry-in/carry-out zone 46.

The semiconductor wafer W, which has been carried onto the chuck means 44 with its back side facing upward and exposed, is located in the rough grinding zone 48, together with the chuck means 44, by the intermittent rotation of the turntable 42. In the rough grinding zone 48, the chuck means 44 holding the semiconductor wafer W is rotated, and the grinding tool 38*a* is also rotated at a high speed. The grinding tool 38*a* is pressed against the back side of the semiconductor wafer W and gradually lowered, whereby the back side of the semiconductor wafer W is ground. The central axis of the grinding tool 38*a* and the central axis of the chuck means 44 are displaced from each other by a predetermined distance, so that the grinding tool 38*a* is caused to act on the entire back side of the semiconductor wafer W sufficiently uniformly.

The semiconductor wafer W, which has been roughly ground in the rough grinding zone 48, is brought to the precision grinding zone 50, together with the chuck means 44, by the intermittent rotation of the turntable 42. Then, the back side of the semiconductor wafer W is precision-ground by the grinding tool 38*b*. The manner of the precision grinding by the grinding tool 38*b* is the same as the manner of the rough grinding by the grinding tool 38*a*. The semiconductor wafer W, which has been precision-ground in the precision grinding zone 50, is brought to the carry-in/carry-out zone 46, together with the chuck means 44, by the intermittent rotation of the turntable 42. In the carry-in/carry-out zone 46, the back side of the semiconductor wafer W is polished in a manner to be described later in further detail.

Then, the transport mechanism 64 transports the semiconductor wafer W on the chuck means 44, located in the carry-in/carry-out zone 46, to the cleaning means 60. The cleaning means 60 jets a cleaning liquid, which may be pure water, while rotating the semiconductor wafer W at a high speed, to clean the semiconductor wafer W, and dries it. The transport mechanism 56 turns the cleaned, dried semiconductor wafer W upside down again to direct it faceup, and carries it into the cassette C placed on the cassette carry-out zone 54. After all of the semiconductor wafers W in the cassette C placed in the cassette carry-in zone 52 are carried outward, this cassette C is replaced by a next cassette C accommodating semiconductor wafers W having back sides to be ground and polished. When a predetermined number of semiconductor wafers W are accommodated into the cassette C placed in the cassette carry-out zone 54, this cassette C is carried outward, and an empty cassette C is placed there.

Constitutions and actions other than the above-described constitutions and actions of the illustrated grinding/polishing machine, i.e., the constitutions and actions concerned with polishing of the back side of the semiconductor wafer W in the carry-in/carry-out zone 46, are substantially the same as the constitutions and actions in the grinding machine sold, for example, by DISCO under the trade name "DFG841", and are already well known among people skilled in the art. Therefore, detailed descriptions of these constitutions and actions are omitted herein.

Figure 10:
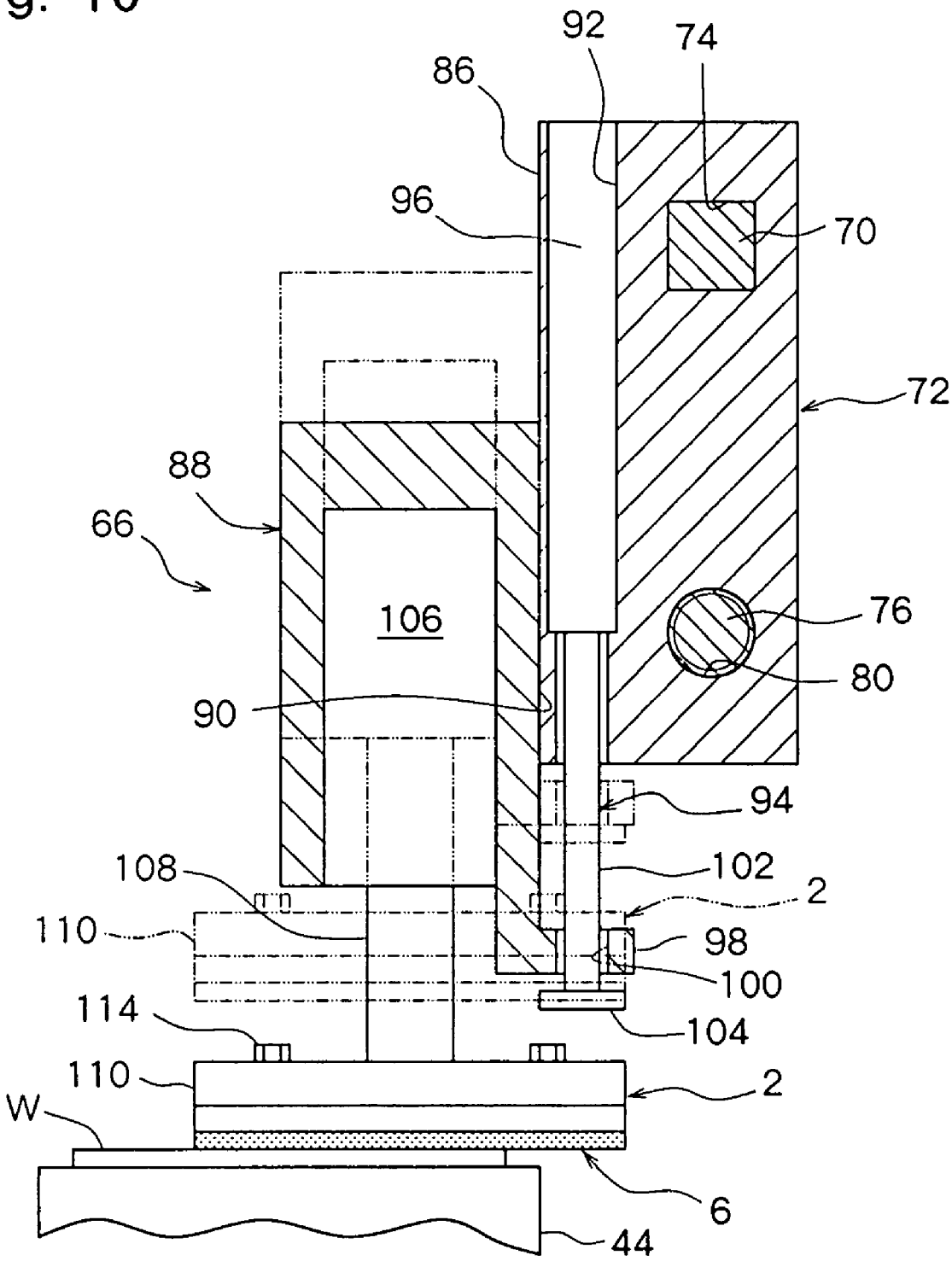
FIG. 10 is a sectional view showing a part of a polishing apparatus in the grinding/polishing machine of FIG. 9.

In the illustrated grinding/polishing machine, a polishing apparatus 66 for polishing the ground back side of the semiconductor wafer W is disposed in addition to the rough grinding device 18*a* and the precision grinding device 18*b* for grinding the back side of the semiconductor wafer W. With reference to FIG. 10 along with FIG. 9, struts 67 and 68 extending substantially vertically upwardly are disposed on opposite side edge portions of the latter-half upper surface of the main portion 14 of the housing 12. A guide rail 70 extending substantially horizontally is fixed between the struts 67 and 68, and a slide block 72 is slidably mounted on the guide rail 70. As will be clearly understood by reference to FIG. 10 along with FIG. 9, the guide rail 70 has a rectangular cross sectional shape, and an opening 74 of a rectangular cross sectional shape, through which the guide rail 70 is inserted, is formed in the slide block 72. A threaded shaft 76 extending substantially horizontally is further mounted rotatably between the struts 67 and 68. An electric motor 78 is mounted on the strut 68, and an output shaft of the electric motor 78 is connected to the threaded shaft 76. A tapped through-hole 80 extending substantially horizontally is formed in the slide block 72, and the threaded shaft 76 is screwed to the tapped hole 80. Thus, when the electric motor 78 is rotated in the normal direction, the slide block 72 is moved forward in a direction indicated by an arrow 82. When the electric motor 78 is rotated in the reverse direction, the slide block 72 is moved backward in a direction indicated by an arrow 84.

Referring to FIGS. 9 and 10, a guide rail 86 extending substantially vertically is formed on the front surface of the slide block 72, and an up-and-down block 88 is mounted so as to be slidable along the guide rail 86. The cross sectional shape of the guide rail 86 is an inverted trapezoidal shape progressively increasing in width in a forward direction, namely, a dovetail shape. A guided groove 90 having a corresponding cross sectional shape is formed in the up-and-down block 88, and the guided groove 90 is engaged with the guide rail 86. As clearly shown in FIG. 10, a through-hole 92 extending substantially vertically is formed in the guide rail 86 of the slide block 72. A cylinder 96 of a pneumatic cylinder mechanism 94 is fixed in the through-hole 92. A protrusion 98 protruding rearward is formed in a lower end portion of the up-and-down block 88, and an opening 100 is formed in the protrusion 98. A piston 102 of the pneumatic cylinder mechanism 94 stretches downward from the slide block 72, and extends downward through the opening 100 formed in the protrusion 98 of the up-and-down block 88. A flange 104 larger than the opening 100 is fixed to the lower end of the piston 102. An electric motor 106 is fixed in the up-and-down block 88, and a rotating shaft 108 extending substantially vertically is connected to the output shaft of the electric motor 106. A mounting member 110 is fixed to the lower end of the rotating shaft 108 stretched downward from the up-and-down block 88. The polishing tool 2 shown in FIGS. 1 and 2 is fixed to the lower surface of the mounting member 110. In further detail, the mounting member 110 is in the form of a disk having substantially the same outer diameter as the outer diameter of the support member 4 of the polishing tool 2, and has a plurality of (four in the drawing) through-holes formed at circumferentially spaced locations. Set screws 114 are screwed into the tapped blind holes 7 formed in the support member 4 of the polishing tool 2 to fix the polishing tool 2 to the lower surface of the mounting member 110. In the illustrated embodiment, moreover, cleaning means 116 for jetting a cleaning liquid, optionally pure water, toward the semiconductor wafer W held on the chuck means 44 located in the carry-in/carry-out zone 46, and drying means 118 for jetting air, preferably heated air, toward the semiconductor wafer W held on the chuck means 44 located in the carry-in/carry-out zone 46 are disposed in the main portion 14 of the housing 12.

The actions of the polishing apparatus 66 will be described in summary. When the turntable 42 is intermittently rotated, or when the semiconductor wafer W is carried onto the chuck means 44 located in the carry-in/carry-out zone 46, or when the semiconductor wafer W is carried outward from the chuck means 44 located in the carry-in/carry-out zone 46, the piston 102 of the pneumatic cylinder mechanism 94 is contracted to a position indicated by two-dot chain lines in FIG. 10. As a result, the flange 104 disposed at the front end of the piston 102 acts on the protrusion 98 of the up-and-down block 88, whereby the up-and-down block 88 is lifted to an ascent position indicated by two-dot chain lines in FIG. 10. When the up-and-down block 88 is brought to the ascent position, the polishing tool 2 of the polishing apparatus 66 is separated upward from the chuck means 44 located in the carry-in/carry-out zone 46 and the semiconductor wafer W held thereon. When the chuck means 44 holding the semiconductor wafer W, whose back side has been rough-ground in the rough grinding zone 48 and precision-ground in the precision grinding zone 50 upon intermittent rotation of the turntable 42, is located in the carry-in/carry-out zone 46, the cleaning means 116 jets the cleaning liquid at the back side of the semiconductor wafer W to discharge grinding swarf from the back side of the semiconductor wafer W. Then, the drying means 118 jets air at the back side of the semiconductor wafer W to dry it.

Then, the piston 102 of the pneumatic cylinder mechanism 94 is stretched to a position indicated by solid lines in FIG. 10. By so doing, the flange 104 disposed at the front end of the piston 102 is separated downward from the protrusion 98 of the up-and-down block 88. Thus, the polishing means 6 of the polishing tool 2 is pressed against the back side of the semiconductor wafer W under the own weight of the up-and-down block 88 and the electric motor 106, rotating shaft 108, mounting member 110 and polishing tool 2 mounted on the up-and-down block 88. If desired, a suitable elastic urging means, such as a compression spring, may be disposed in addition to or instead of the own weight of the up-and-down block 88 and the various constituent elements mounted thereon, and the polishing means 6 may be pressed against the back side of the semiconductor wafer W by the elastic urging means. Just when or before or after the polishing means 6 of the polishing tool 2 is pressed against the back side of the semiconductor wafer W, the chuck means 44 is rotated and the motor 106 is energized to rotate the polishing tool 2. Then, the motor 78 repeats normal and reverse rotations, whereby the slide block 72 is caused to make forward and backward movements in the directions indicated by arrows 82 and 84. Thus, the polishing tool 2 is moved forward and backward in the directions indicated by arrows 82 and 84. In this manner, the back side of the semiconductor wafer W is polished.

According to the inventors' experience, in polishing the back side of the semiconductor wafer W by the polishing tool 2 in the foregoing manner, it is preferred to rotate the chuck means 44 at a relatively low rotational speed of, preferably 5 to 200 rpm, particularly 10 to 30 rpm, and rotate the polishing tool 2 at a relatively high rotational speed of, preferably 2,000 to 20,000 rpm, particularly 5,000 to 8,000 rpm. The direction of rotation of the chuck means 44 and the direction of rotation of the polishing tool 2 may be the same, but advantageously are in opposition to each other. In regard to the forward and backward movements of the polishing tool 2 in the directions indicated by the arrows 82 and 84, the polishing tool 2 can be reciprocated once in 30 to 90 seconds at an amplitude equal to or somewhat larger than the diameter of the semiconductor wafer W. The pressing force of the polishing tool 2 imposed on the back side of the semiconductor wafer W is preferably 100 to 300 g/cm$^2$, especially 180 to 220 g/cm$^2$. As shown in FIG. 10, the diameter of the polishing means 6 of the polishing tool 2 may be nearly the same as the diameter of the semiconductor wafer W. In order that the entire polishing means 6 acts fully uniformly on the entire back side of the semiconductor wafer W, the central axis of the semiconductor wafer W held on the chuck means 44 and the central axis of the polishing means 6 are preferably displaced from each other by about a third to a half of the radius of the polishing means 6 in a substantially horizontal direction (i.e., a direction perpendicular to the rotation axis of the chuck means 44 and the rotation axis of the polishing tool 2) and in a direction perpendicular to the directions of forward and backward movements of the polishing tool 2 indicated by the arrows 82 and 84.

When the back side of the semiconductor wafer W is rough-ground by the rough grinding device 18*a* and precision-ground by the precision grinding device 18*b*, a so-called saw mark is generated in the back side of the semiconductor wafer W, and so-called processing distortion (such processing distortion can be clearly grasped by observation with a transmission electron microscope) is generated over a depth of about 0.2 μm from the back side. After grinding, the back side of the semiconductor wafer W is polished by the polishing tool 2 constructed according to the present invention to remove the surface layer over a depth of about 1.0 μm. By this means, the back side of the semiconductor wafer W can be mirror-finished, and the processing distortion can be substantially eliminated.

Figure 11:
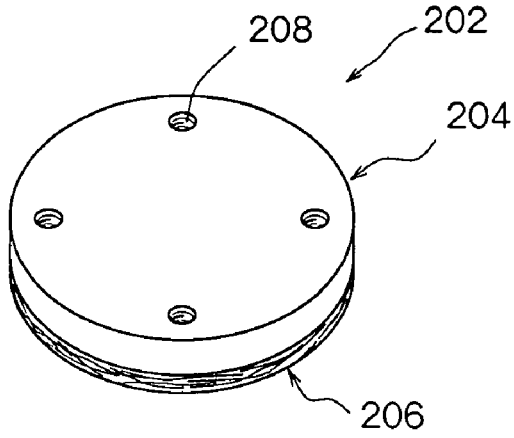
FIG. 11 is a perspective view showing another preferred embodiment of the polishing tool constructed in accordance with the present invention.
Figure 12:
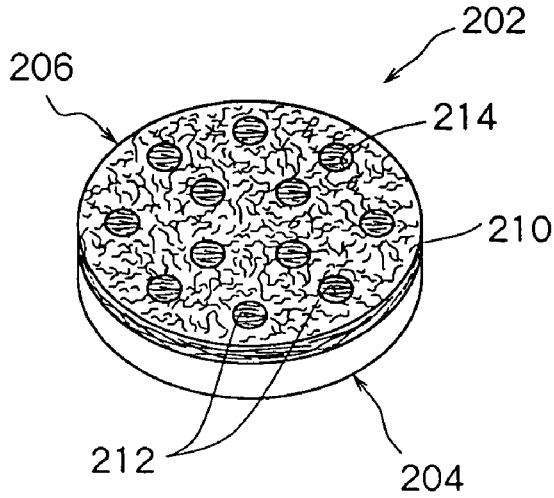
FIG. 12 is a perspective view showing the polishing tool of FIG. 11 in an inverted state.

FIGS. 11 and 12 show another preferred embodiment of a polishing tool constructed in accordance with the present invention. A polishing tool, shown entirely by a numeral 202, comprises a support member 204 and polishing means 206. The support member 204 is advantageously formed from a suitable metal such as aluminum, is disc-shaped, and has a flat circular support surface, namely, a lower surface. As shown in FIG. 11, a plurality of (four in the drawings) tapped blind holes 208, extending downward from an upper surface of the support member 204, are formed at circumferentially spaced locations in the support member 204. The polishing means 206 is also disc-shaped, and the outer diameter of the support member 204 and the outer diameter of the polishing means 206 are substantially the same. The polishing means 206 is bonded to the lower surface of the support member 204 (i.e., its flat circular support surface) by a suitable adhesive such as an epoxy resin adhesive.

It is important for the polishing means 206 to be composed of a massive body formed from at least two types of fibers selected from natural fibers and synthetic fibers, and abrasive grains dispersed in the massive body. Examples of the natural fibers are animal fibers such as wool, goat hair, pig hair, horse hair, cattle hair, dog hair, cat hair, raccoon dog hair, and fox hair, vegetable fibers such as cotton and hemp, and mineral fibers such as asbestos. Examples of the synthetic fibers are nylon fibers, polyethylene fibers, polypropylene fibers, polyester fibers, acrylic fibers, rayon fibers, Kevlar fibers, and glass fibers. The massive body formed by compressing the fibers into a mass form may be felt or a bundle of fibers, and preferably has a density of 0.20 g/cm$^3$ or more, especially 0.40 g/cm$^3$ or more, and a hardness of 30 or more, especially 50 or more. Too low a density and too low a hardness tend to result in a decrease in the polishing efficiency and deterioration in the polishing quality.

The amount of the abrasive grains dispersed in the massive body is preferably 0.05 to 1.00 g/cm$^3$, particularly 0.20 to 0.70 g/cm$^3$. The abrasive grains dispersed in the massive body may themselves be substantially the same as the abrasive grains in the polishing means 6 shown in FIGS. 1 and 2. To disperse the abrasive grains appropriately in the massive body, it is permissible, for example, to incorporate the abrasive grains into a suitable liquid, and then impregnate the massive body with the liquid, or to incorporate the abrasive grains, as desired, into the fibers as a material for the massive body during the manufacturing process of the massive body. After the abrasive grains are appropriately dispersed in the massive body, the massive body is impregnated with a suitable liquid adhesive, for example, a phenolic resin adhesive or an epoxy resin adhesive, so that the abrasive grains can be bound into the massive body by such an adhesive.

As will be clearly understood by reference to FIG. 12, the massive body of the polishing means 206 is composed of a first felt 210 and a plurality of second felts 212 in the embodiment shown in FIGS. 11 and 12. The first felt 210 is formed from first fibers, while the second felt 212 is formed from second fibers different from the first fibers. The first felt 210 is circular as a whole, and a plurality of voids 214 piercing through the first felt 210 in its thickness direction are formed at suitable intervals in the first felt 210. The cross sectional shape of each of the voids 214 may be a circle of a relatively small diameter. The plurality of second felts 212 each take a cylindrical shape of a relatively small diameter, and are fitted into the voids 214 formed in the first felt 210. In a polishing surface or lower surface of the polishing means 206, the second felts 212 are arranged dispersedly in the first felt 210. By force-fitting the second felts 212 into the voids 214, the second felts 212 can be fastened to the voids 214 of the first felt 210. Instead, the second felts 212 may be fastened to the voids 214 of the first felt 210 by use of a suitable adhesive. The first felt 210 can be formed from wool, and the second felts 212 can be formed from goat hair. Alternatively, the first felt 210 can be formed from goat hair, and the second felts 212 can be formed from wool.

Figure 13:
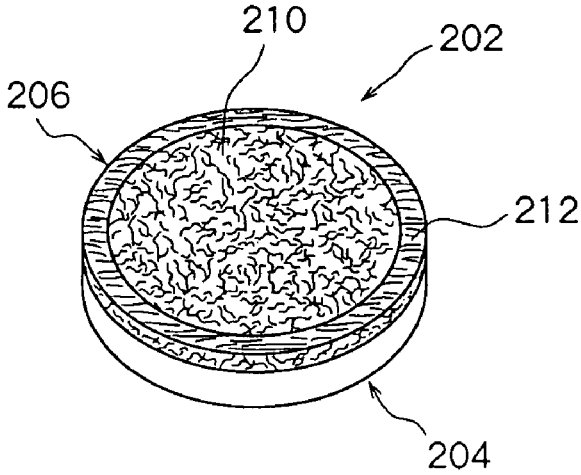
FIG. 13 is a perspective view similar to FIG. 12, illustrating a modified mode of combination of a first felt and a second felt forming a massive body of polishing means.
Figure 14:
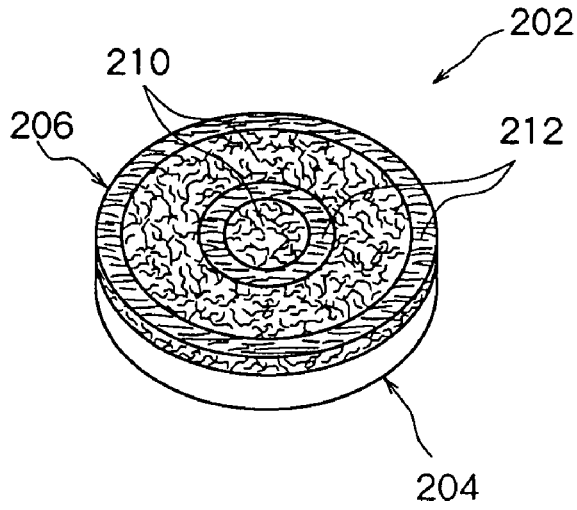
FIG. 14 is a perspective view similar to FIG. 12, illustrating another modified mode of combination of the first felt and the second felt forming the massive body of the polishing means.
Figure 15:
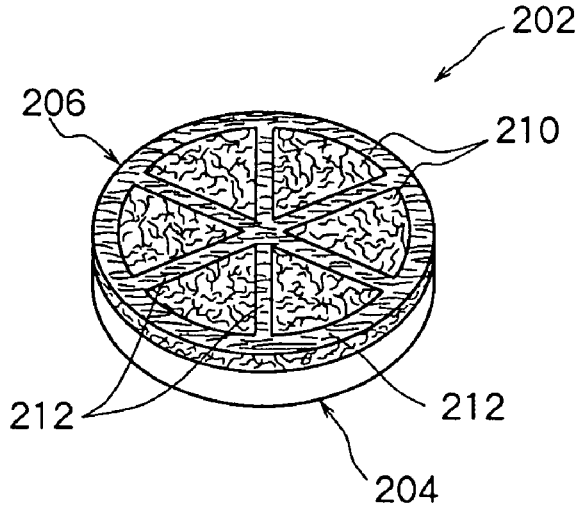
FIG. 15 is a perspective view similar to FIG. 12, illustrating still another modified mode of combination of the first felt and the second felt forming the massive body of the polishing means.

FIGS. 13 to 15 show modified modes of combination of the first felt 210 and the second felt 212 forming the massive body. In the polishing means 206 of the polishing tool 202 shown in FIG. 13, the first felt 210 is disc-shaped, and the second felt 212 is shaped like a doughnut surrounding the first felt 210. In the polishing means 206 of the polishing tool 202 shown in FIG. 14, the first felts 210 and the second felts 212 are arranged alternately concentrically, the first felts 210 include two portions, i.e., a central cylindrical portion and an intermediate doughnut-shaped portion, and the second felts 212 include an intermediate doughnut-shaped portion and an outer doughnut-shaped portion. In the polishing means 206 of the polishing tool 202 shown in FIG. 15, the first felts 210 include six segment-shaped portions, while the second felts 212 include six radially extending linear portions and an outer annular portion.

Figure 16:
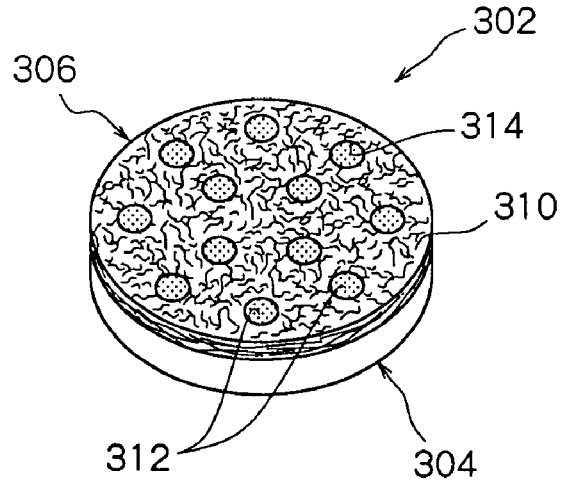
FIG. 16 is a perspective view similar to FIG. 12, showing a still additional embodiment, in an inverted state, of the polishing tool constructed in accordance with the present invention.

FIG. 16 shows another embodiment of a polishing tool constructed in accordance with the present invention. A polishing tool 302 shown in FIG. 16 is also composed of a support member 304 and polishing means 306. The support member 304 may be the same as the support member 202 in the polishing tool 202 shown in FIGS. 11 and 12. The polishing means 306, composed of a massive body and abrasive grains dispersed in the massive body, is disc-shaped, and is bonded to a flat circular support surface or lower surface of the support member 304 via a suitable adhesive. The massive body of the polishing means 306 is constituted from a felt 310 formed from first fibers, and a plurality of fiber bundles 312 formed from second fibers different from the first fibers. The first fibers forming the felt 310 may be wool or goat hair. The second fibers constituting the fiber bundle 312 may be animal hair other than wool and goat hair, for example, pig hair, horse hair, cattle hair, dog hair, cat hair, raccoon dog hair, or fox hair. The fiber bundle 312 can be formed by tying many fibers in a bundle, and compressing the resulting bundle by a required compressive force. In the embodiment illustrated in FIG. 16, the felt 310 is circular as a whole, and a plurality of voids 314 piercing through the felt 310 in its thickness direction are formed at suitable intervals in the felt 310. The cross sectional shape of each of the voids 314 is a circle of a relatively small diameter. The plurality of fiber bundles 312 each take a cylindrical shape of a relatively small diameter, and are fitted into the voids 314 formed in the felt 310. In the lower surface of the polishing means 306, the fiber bundles 312 are arranged dispersedly in the felt 310. The fiber bundles 312 are fastened to the voids 314 of the felt 310 by being force-fitted into the voids 314, or via a suitable adhesive.

Figure 17:
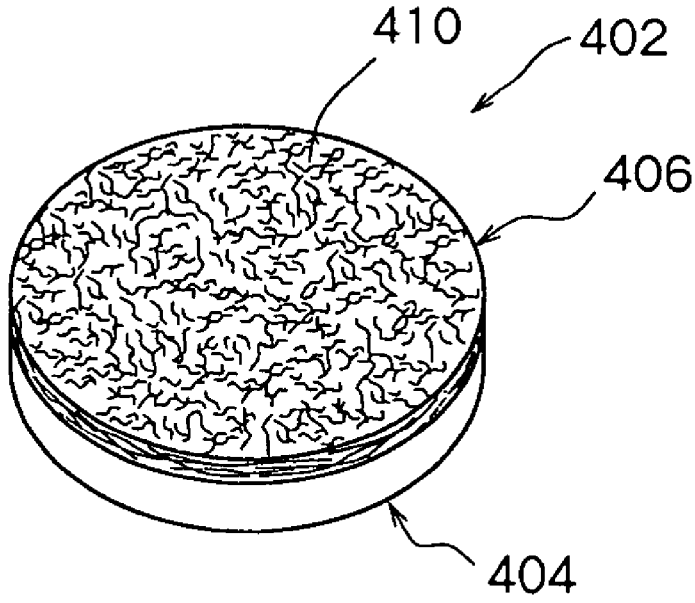
FIG. 17 is a perspective view similar to FIG. 12, showing a further additional embodiment, in an inverted state, of the polishing tool constructed in accordance with the present invention.

FIG. 17 shows still another embodiment of a polishing tool constructed in accordance with the present invention. A polishing tool 402 shown in FIG. 17 is also composed of a support member 404 and polishing means 406. The support member 404 may be the same as the support member 204 in the polishing tool 202 shown in FIGS. 11 and 12. The polishing means 406, composed of a massive body and abrasive grains dispersed in the massive body, is disc-shaped, and is bonded to a flat circular support surface or lower surface of the support member 404 via a suitable adhesive. The massive body of the polishing means 406 is formed from a single felt 410, which itself is formed from a mixture of at least two types of fibers. For example, wool and goat hair may be mixed in suitable proportions to form the felt 410.

The preferred embodiments of the present invention have been described in detail with reference to the accompanying drawings. However, it is to be understood that the present invention is not restricted to these embodiments, but various changes and modifications may be made without departing from the spirit and scope of the invention.

What we claim is:

1. A polishing method comprising:

rotating a workpiece and also rotating polishing means, the workpiece and the polishing means rotating in opposite directions; and pressing the polishing means against a surface of the workpiece to be polished, and wherein the polishing means is constructed by dispersing abrasive grains in felt having a density of 0.20 g/cm$^3$ or more and a hardness of 30 or more.

2. The polishing method of claim 1, wherein the workpiece is a semiconductor wafer, and the surface to be polished is a ground back side.

3. The polishing method of claim 1, wherein the density of the felt is 0.40 g/cm$^3$ or more.

4. The polishing method of claim 1, wherein the hardness of the felt is 50 or more.

5. The polishing method of claim 1, wherein the polishing means contains 0.05 to 1.00 g/cm$^3$ of the abrasive grains.

6. The polishing method of claim 5, wherein the polishing means contains 0.20 to 0.70 g/cm$^3$ of the abrasive grains.

7. The polishing method of claim 1, wherein the felt includes not less than 90% by weight of wool.

8. The polishing method of claim 1, wherein a polishing surface of the polishing means includes both of a course surface and a wale surface of the felt.

9. The polishing method of claim 1, wherein the abrasive grains have particle diameters of 0.01 to 100 μm.

10. The polishing method of claim 1, wherein the abrasive grains include one or more of silica, alumina, forsterite, steatite, mullite, cubic boron nitride, diamond, silicon nitride, silicon carbide, boron carbide, barium carbonate, calcium carbonate, iron oxide, magnesium oxide, zirconium oxide, cerium oxide, chromium oxide, tin oxide, and titanium oxide.

11. The polishing method of claim 1, wherein a rotational speed of the workpiece is 5 to 200 rpm, and a rotational speed of the polishing means is 2,000 to 20,000 rpm.

12. The polishing method of claim 11, wherein the rotational speed of the workpiece is 10 to 30 rpm, and the rotational speed of the polishing means is 5,000 to 8,000 rpm.

13. The polishing method of claim 1, wherein the polishing means is pressed against the workpiece at a pressing force of 100 to 300 g/cm$^2$.

14. The polishing method of claim 13, wherein the polishing means is pressed against the workpiece at a pressing force of 180 to 220 g/cm$^2$.

15. The polishing method of claim 1, wherein the workpiece is a nearly disc-shaped semiconductor wafer, the polishing means is disc-shaped, an outer diameter of the semiconductor wafer and an outer diameter of the polishing means are nearly identical, and a central axis of the semiconductor wafer and a central axis of the polishing means are positioned so as to be displaced from each other by a third to a half of a radius of the semiconductor wafer.

16. The polishing method of claim 15, wherein the polishing means is moved back and forth relative to the workpiece in a direction perpendicular to a rotation axis of the polishing means and perpendicular to a direction in which a central axis of the semiconductor wafer and a central axis of the polishing means are displaced from each other.

17. The polishing method of claim 16, wherein the polishing means is moved back and forth at such a speed as to be reciprocated once in 30 to 60 seconds at an amplitude equal to or somewhat larger than a diameter of the semiconductor wafer.

* * * * *